US009789708B2

(12) United States Patent
Sasaki

(10) Patent No.: US 9,789,708 B2
(45) Date of Patent: Oct. 17, 2017

(54) LIQUID EJECTING APPARATUS

(71) Applicant: Seiko Epson Corporation, Tokyo (JP)

(72) Inventor: Tsuneyuki Sasaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/213,633

(22) Filed: Jul. 19, 2016

(65) Prior Publication Data

US 2017/0021643 A1 Jan. 26, 2017

(30) Foreign Application Priority Data

Jul. 21, 2015 (JP) ..... 2015-143686

(51) Int. Cl.

| | |
|---|---|
| ***B41J 11/00*** | (2006.01) |
| ***B41J 15/16*** | (2006.01) |
| ***B65H 23/34*** | (2006.01) |
| ***B41J 13/22*** | (2006.01) |

(52) U.S. Cl.

CPC ..... *B41J 11/0085* (2013.01); *B41J 11/0005* (2013.01); *B41J 13/226* (2013.01); *B41J 15/16* (2013.01); *B65H 23/34* (2013.01)

(58) Field of Classification Search

CPC ..... B41J 11/0005

See application file for complete search history.

(56) References Cited

U.S. PATENT DOCUMENTS 6,293,669 B1 * 9/2001 Uchida ..... B41J 11/005 347/104
9,090,424 B1 * 7/2015 Armbruster ..... B41J 11/00
2002/0171727 A1 11/2002 Kida et al.
2003/0142190 A1 * 7/2003 Rasmussen ..... B41J 11/005 347/104
2004/0126164 A1 * 7/2004 Ohyama ..... B41J 11/005 400/58
2009/0212495 A1 * 8/2009 Okuno ..... B41J 11/005 271/272
2012/0242737 A1 * 9/2012 Tanase ..... B41J 11/002 347/16
2014/0125750 A1 5/2014 Sasaki et al.

(Continued)

FOREIGN PATENT DOCUMENTS

JP 2001-031288 A 2/2001
JP 2001-334646 A 12/2001

(Continued)

*Primary Examiner* — Shelby Fidler

(74) *Attorney, Agent, or Firm* — Workman Nydegger

(57) ABSTRACT

A liquid ejecting apparatus including a liquid ejecting unit that ejects a liquid onto a medium, a transporting mechanism that transports the medium, a member having concave portions, which is arranged downstream of the liquid ejecting unit in a transporting direction of the medium, an introducing mechanism that introduces the medium to the concave portions, the transporting mechanism having rollers that come into contact with the medium at a plurality of contact positions in a direction that intersects the transporting direction, and the concave portions being arranged at positions that correspond to a position between neighboring ones of the contact positions in the transporting direction. By giving the liquid ejecting apparatus such a structure, wrinkles that occur in a liquid ejection region can be suppressed.

6 Claims, 7 Drawing Sheets

(56) References Cited

U.S. PATENT DOCUMENTS

| | | | | |
|---|---|---|---|---|
| 2014/0218423 | A1 | 8/2014 | Sasaki et al. | |
| 2016/0167406 | A1* | 6/2016 | Piatt | B41J 11/0005 347/104 |

FOREIGN PATENT DOCUMENTS

| | | | |
|---|---|---|---|
| JP | 2014-091302 | A | 5/2014 |
| JP | 2014-151976 | A | 8/2014 |

* cited by examiner

LIQUID EJECTING APPARATUS

BACKGROUND

1. Technical Field

The present invention relates to a liquid ejecting apparatus.

2. Related Art

To date, a liquid ejecting apparatus that ejects a liquid onto a medium has been used. In such a liquid ejecting apparatus, when a medium rises up from a supporting unit for the medium, the medium and a liquid ejecting unit may come into contact with each other and the impact accuracy of the liquid to the medium may decrease. Accordingly, a technique for suppressing such rising up of the medium from the supporting unit has been disclosed.

For example in JP-A-2001-334646, a liquid ejecting apparatus (ink jet printer) that suppresses rising up of the medium from the supporting unit by attracting the medium onto an attracting roller is disclosed.

The medium rises from the supporting unit due to various reasons, and depending on the shape of the transporting mechanism of the medium, specific portions may particularly easily rise up. In a liquid ejecting apparatus having a structure in which such specific portions particularly easily rise up, wrinkles occur in a medium due to such specific portions, and wrinkles may reach a liquid ejection region.

However, even though the liquid ejecting apparatus disclosed in JP-A-2001-334646 can suppress rising up of a medium from a supporting unit on the whole, it does not effectively suppress wrinkles that occur in the specific portions due to particularly easy rising up of the particular specific portions. Consequently, wrinkles may occur in the medium, wrinkles may reach the liquid ejection region, the medium may come into contact with the liquid ejecting unit, and the like, and the liquid impact accuracy of a liquid to the medium may decrease. In this way, in the conventional liquid ejecting apparatus, wrinkles may occur in the liquid ejection region.

SUMMARY

An advantage of some aspects of the invention is that wrinkles that occur in the liquid ejection region are suppressed.

A liquid ejecting apparatus according to an aspect of the invention has a liquid ejecting unit that ejects a liquid onto a medium, a transporting mechanism that transports the medium, a member having concave portions that are arranged downstream of the liquid ejecting unit in a transporting direction of the medium, an introducing mechanism that introduces the medium to the concave portions, the transporting mechanism having rollers that come into contact with the medium at a plurality of contact positions in a direction that intersects the transporting direction, and the concave portions being arranged at positions that correspond to positions between neighboring ones of the contact positions in the transporting direction.

According to this aspect, the member having the concave portions that are arranged downstream of the liquid ejecting unit in the transporting direction and the introducing mechanism that introduces the medium to the concave portions are included in the liquid ejecting apparatus. Consequently, in a structure in which specific portions particularly easily rise up, concave portions are arranged at positions corresponding to the specific portions, and by introducing the medium to the concave portions, wrinkles that easily occur in the specific portions can be effectively suppressed. Therefore, it is possible to suppress wrinkles that occur in a liquid ejection region.

Moreover, whereas the transporting mechanism having a roller that comes into contact with the medium at a plurality of contact positions has a structure that has a high transporting accuracy and is easy to form, wrinkles easily occur in space portions between the contact positions. However, according to this aspect, a member having concave portions and an introducing mechanism that introduces a medium to the concave portions are included in the liquid ejecting apparatus. Consequently, the concave portions are arranged at positions corresponding to the space portions, and by introducing the medium to the concave portions, wrinkles that easily occur in the space portions can be suppressed effectively. Therefore, together with ease of formation of a transporting mechanism that has a high transporting accuracy, the wrinkles occurring in a liquid ejection region can be suppressed.

Furthermore, according to this aspect, concave portions are arranged at positions that correspond to positions between neighboring contact positions in the transporting direction. Consequently, because the concave portions are arranged at positions corresponding to the space portions, by introducing the medium to the concave portions, wrinkles that easily occur in the space portions can be suppressed effectively. Therefore, together with ease of formation of a transporting mechanism that has a high transporting accuracy, the wrinkles that occur in a liquid ejection region can be suppressed.

In the liquid ejecting apparatus, the transporting mechanism transports the medium while applying a tension in the transporting direction, and the introducing mechanism is a structure that pushes the medium against the concave portions due to the member being arranged so as to subject the medium to tensions in different directions with the member as a reference when viewed from a direction that intersects the transporting direction and an ejection direction of the liquid.

According to this aspect, the transporting mechanism is a structure that transports a medium while applying a tension in the transporting direction. Moreover, the introducing mechanism is a structure that pushes the medium against the concave portions due to the member being arranged so as to subject the medium to tensions in different directions with the member as a reference when viewed from a direction that intersects the transporting direction and an ejection direction of the liquid. Consequently, it is possible to easily form the introducing mechanism that does not come into contact with a side of the target recording medium on which a liquid is applied.

Further, "a structure that transports the medium while applying a tension in the transporting direction" can be considered to be, for example, a so-called "roll to roll" structure or the like that includes a setting unit for setting a medium having a roll shape and a winding unit for winding the medium into a roll shape and that can transport the medium while applying a tension in the transporting direction from the setting unit to the winding unit.

In the liquid ejecting apparatus, the member is an assist roller that assists in transporting of the medium.

According to this aspect, the member is an assist roller that assists in transporting of the medium. Consequently, it is possible to increase the transporting accuracy of the medium.

In the liquid ejecting apparatus, suction holes are arranged in the concave portions.

According to this aspect, suction holes are arranged in the concave portions. Consequently, it is possible to particularly improve the effect of introducing the medium to the concave portions and it is possible to effectively suppress wrinkles that occur in the liquid ejection region.

In the liquid ejecting apparatus, suction holes are arranged in the concave portions and a cover unit that covers the suction holes is arranged on a side of the assist roller that is different from the side that comes into contact with the medium.

According to this aspect, suction holes are arranged in the concave portions and a cover unit that covers the suction holes is arranged on the side of the assist roller that is different from the side which comes into contact with the medium. Consequently, by suppressing suction from the side of the assist roller that is different from the side that comes into contact with the medium, it is possible to increase the suction force on the side of the assist roller that comes into contact with the medium. That is, it is possible to particularly improve the effect of introducing the medium to the concave portions and it is possible to effectively suppress wrinkles that occur in the liquid ejection region.

In the liquid ejecting apparatus, a supporting unit that supports the medium in the transporting path of the medium is included and suction holes are arranged in the supporting unit.

According to this aspect, a supporting unit that supports the medium in the transporting path of the medium is included in the liquid ejecting apparatus and suction holes are arranged in the supporting unit. Consequently, in a structure in which specific portions easily rise up, by arranging the suction holes at positions corresponding to the specific portions in the supporting unit, it is possible to particularly effectively suppress wrinkles that easily occur in the specific portions. Therefore, it is possible to effectively suppress wrinkles that form in a liquid ejection region.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the recording device according to an embodiment of the invention as a liquid ejecting apparatus of the invention will be described with reference to the accompanying drawings.

First Embodiment (FIGS. 1 to 5)

Figure 1:
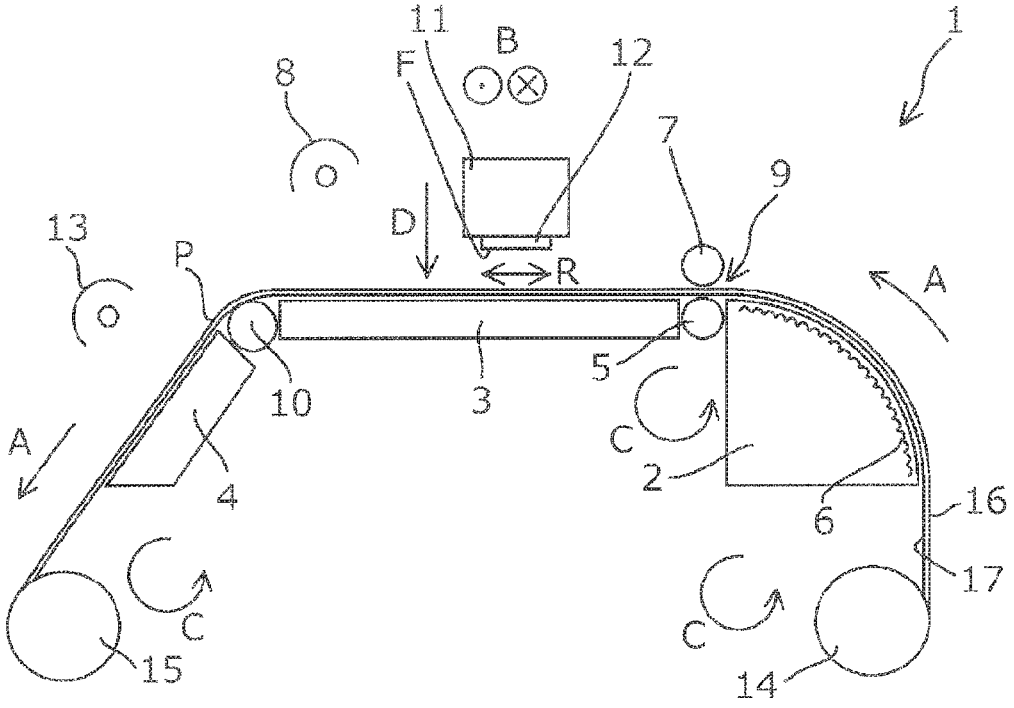
FIG. 1 is a schematic side view of a recording device according to a first embodiment of the invention.

FIG. 1 is a schematic side view of a recording device 1 according to a first embodiment of the invention.

As illustrated in FIG. 1, the recording device 1 of this embodiment transports a target recording medium P in a transporting direction A from a setting unit 14 for setting the target recording medium P, along a platen 2, a platen 3 and a platen 4 that are supporting units for supporting the target recording medium (medium) P, and up to a winding unit 15 for winding the target recording medium P. That is, the path from the setting unit 14 to the winding unit 15 is the transporting path for the target recording medium P in the recording device 1 and the platen 2, the platen 3, and the platen 4 are supporting units that are provided on the transporting path and that support the target recording medium P. Further, the setting unit 14 rotates in a rotation direction C and sends out the target recording medium P, and the winding unit 15 rotates in the rotation direction C and winds up the target recording medium P.

Here, the setting unit 14 and the winding unit 15 that form one portion of the transporting mechanism of this embodiment can transport the target recording medium P while applying a tension in the transporting direction A. By adopting such a structure, the setting unit 14 and the winding unit 15 serve as an introducing mechanism for introducing the target recording medium P to an assist roller 10 serving as a member having concave portions 30 (not illustrated in FIG. 2) described later.

Further, the recording device 1 of this embodiment has a structure in which recording can be performed on the target recording medium P in roll form; however, it is not limited to such a structure and may have a structure in which recording can be performed on the target recording medium P in single sheet form. In the case of a structure in which recording can be performed on the target recording medium P in single sheet form, as the setting unit 14 for the target recording medium P, for example, a so-called paper feed (feed) tray, a paper feed (feed) cassette, or the like may be used. Moreover, as a collecting unit for the target recording medium P other than the winding unit 15, for example, a so-called discharge receiving unit, a paper ejection (discharge) tray, a paper ejection (discharge) cassette, or the like may be used.

However, in the case of a structure in which recording can be performed on the target recording medium P in single sheet form, it is necessary to separately establish an introducing mechanism that introduces the target recording medium P to the member having the concave portions 30. As an introducing mechanism used in such a structure, there is no particular limitation; however, for example, it is possible to use a roller that can push the target recording medium P from the side opposite to the platen 3 (a side corresponding to a recording surface 16 of target recording medium P) toward the platen 3.

Further, in this embodiment, because a target recording medium P, which is wound up in a roll in such a manner that the recording surface 16 is on the outer side, is used, when sending out the target recording medium P from the setting unit 14, the rotation shaft of the setting unit 14 rotates in the rotation direction C. However, in the case where a target recording medium P, which is wound up in a roll in such a manner that the recording surface 16 is on the inner side, is used, it is possible for the rotation shaft of the setting unit 14 to rotate in a direction opposite to the rotation direction C and send out the target recording medium P.

Thus, similarly, because the winding unit 15 of this embodiment winds the target recording medium P in such a manner that the recording surface 16 is on the outer side, the rotation shaft of the winding unit 15 rotates in the rotation direction C. However, in the case where the winding is performed in such a manner that the recording surface 16 is on the inner side, it possible for the rotation shaft of the winding unit 15 to rotate in a direction opposite to the rotation direction C and wind the target recording medium P.

A heater 6 is provided in the platen 2 of the recording device 1 of this embodiment. The heater 6 is provided in order to heat up (so-called pre-heat) the target recording medium P before a recording head 12 serving as the recording unit performs recording.

Further, the recording device 1 of this embodiment has a structure in which the target recording medium P is preheated from a surface 17 side which is on the opposite side to the recording surface 16 of the target recording medium P by using the heater 6. However, for example, a structure may be used in which the target recording medium P is preheated from the recording surface 16 side by using a heater that is capable of heating the target recording medium P by irradiating infrared rays from the recording surface 16 side of the target recording medium P.

Moreover, in the recording device 1 of this embodiment, drive rollers 5 that have rotation shaft that extends in an intersecting direction B that intersects the transporting direction A are provided between the platen 2 and the platen 3. The drive rollers 5 apply a feeding force to the surface 17 of the target recording medium P.

In addition, driven rollers 7 that have a rotation shaft that extends in the intersecting direction B are provided at positions that face the drive rollers 5. The target recording medium P can be interposed between the drive rollers 5 and the driven rollers 7 that form roller pairs. By adopting such a structure, a transporting section 9 is formed of the drive rollers 5 and the driven rollers 7. Here, a driven roller refers to a roller that rotates with the transporting of the target recording medium P. Further, the transporting section 9, similarly to the setting unit 14 and the winding unit 15, forms a portion of the transporting mechanism of this embodiment.

Moreover, when the target recording medium P is transported in the transporting direction A, the drive rollers 5 rotate in the rotation direction C and the driven rollers 7 rotate in a direction opposite to the rotation direction C.

Moreover, the recording device 1 of this embodiment is provided with the recording head 12 that serves as a liquid ejecting unit on a side opposite to the platen 3. The recording device 1 forms a desired image by ejecting ink, which is an example of a liquid, in a direction D (a direction toward the target recording medium P from a nozzle forming face F; in this embodiment, a vertically down direction) to a liquid ejection region R of the target recording medium P from the nozzle forming surface F of the recording head 12 while reciprocating the recording head 12 in the intersecting direction B by using a carriage 11. By adopting such a structure, the recording head 12 serving as the liquid ejecting unit can eject ink as a liquid onto the target recording medium P.

Further, the recording device 1 of this embodiment is provided with the recording head 12 that records while moving to and fro; however, a recording device may be used in which nozzles that eject ink are provided in a plurality in the intersecting direction B that intersects the transporting direction A in a so-called line head.

Here, a "line head" is a recording head in which a nozzle region formed in the intersecting direction B that intersects the transporting direction A of the target recording medium P is disposed in such a manner as to be capable of covering the whole of the target recording medium P in the intersecting direction B, and is used in a recording device that forms an image by moving the recording head and the target recording medium P relative to each other. Further, the region of the nozzles in the intersecting direction B of the line head need not cover all types of target recording media P that can be used in the recording device.

A heater 8 serving as a heating unit capable of irradiating infrared rays toward a region (liquid ejection region R) on which recording is to be performed by the recording head 12 is provided on the downstream side of the recording head 12 in the transporting direction A.

Further, the heater 8 is provided at a position facing the platen 3 and is an infrared ray heater capable of heating the recording surface 16 side of the target recording medium P; however, the heater 8 is not limited to such a heater and a heater capable of heating the target recording medium P from the platen 3 side (the surface 17 side) may be used.

Moreover, a heater 13 capable of irradiating infrared rays is provided on the downstream side of the heater 8 in the transporting direction A of the target recording medium P. Further, the heater 13 of this embodiment is provided at a position that faces the platen 4 and is an infrared ray heater capable of heating the recording surface 16 side of the target recording medium P; however, the heater 13 is not limited to such a heater and a heater capable of heating the target recording medium P from the platen 4 side (the surface 17 side) may be used. Moreover, for example, instead of a heating device such as an infrared ray heater, a blowing device such as a fan may be used.

Moreover, the recording device 1 of this embodiment is provided with the assist roller 10 that assists in the transporting of the target recording medium P between the platen 3 and the platen 4. As illustrated in FIG. 1, in the recording device 1 of this embodiment, the setting unit 14 and the winding unit 15 are provided at positions lower than the position of the platen 3, and the target recording medium P is transported while being subjected a tension in the transporting direction A from the setting unit 14 to the winding unit 15. Therefore, as illustrated in FIG. 1, the assist roller 10 is provided between the platen 3 and the platen 4 and the transporting path of the target recording medium P, when viewed from the side, curves at the position of the assist roller 10. By adopting such a structure, the surface 17 of the target recording medium P is pushed against the assist roller 10.

Next, the driven rollers 7 and the assist roller 10 that form the transporting section 9 and which are essential parts of the recording device 1 of this embodiment will be described.

Figure 2:
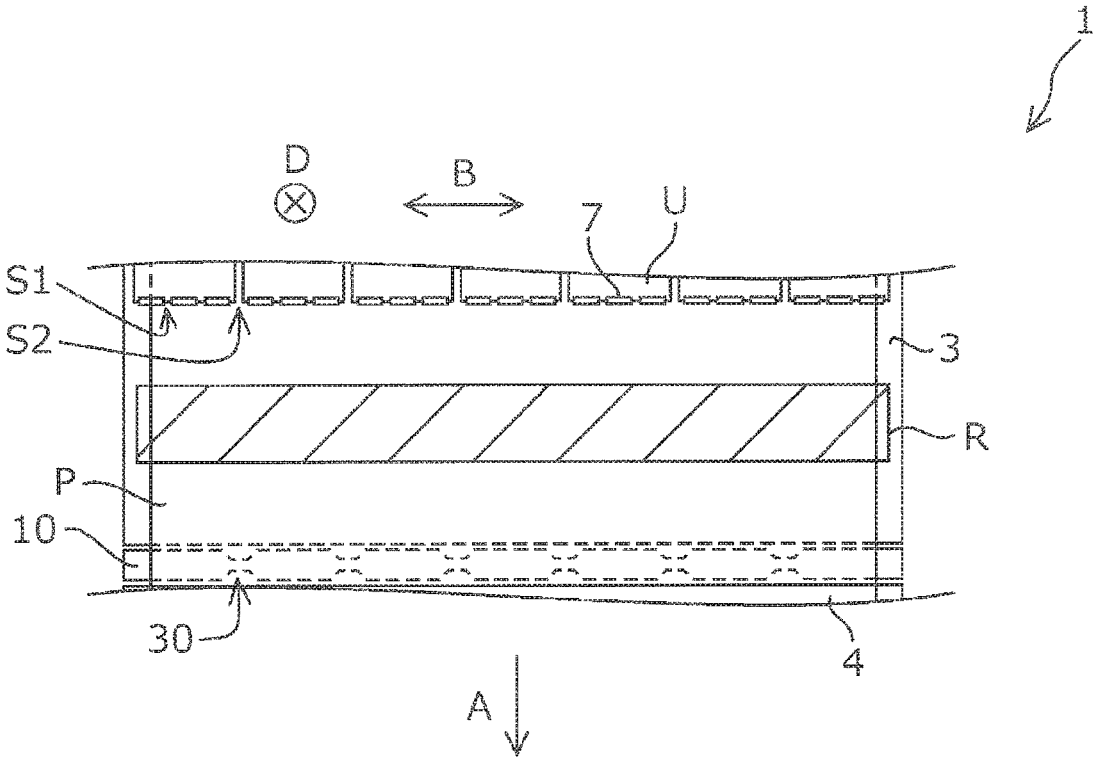
FIG. 2 is a schematic plan view of a main part of the recording device according to the first embodiment of the invention.
Figure 3:
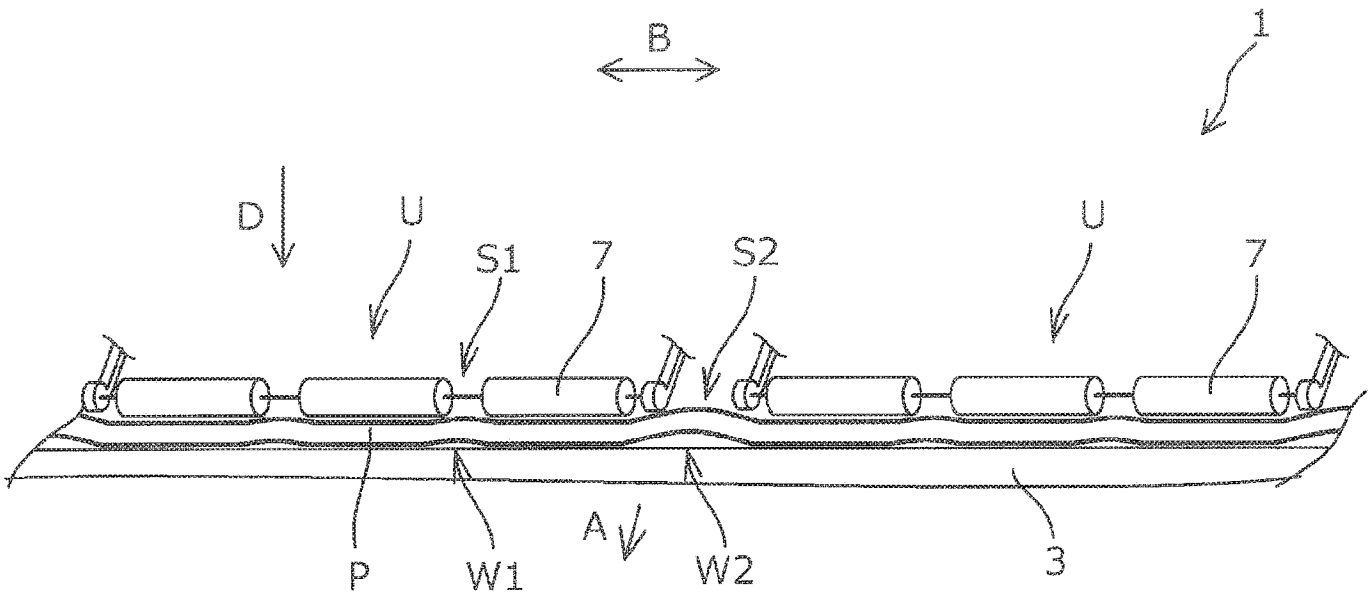
FIG. 3 is a schematic perspective view of the main part of the recording device according to the first embodiment of the invention.
Figure 4:
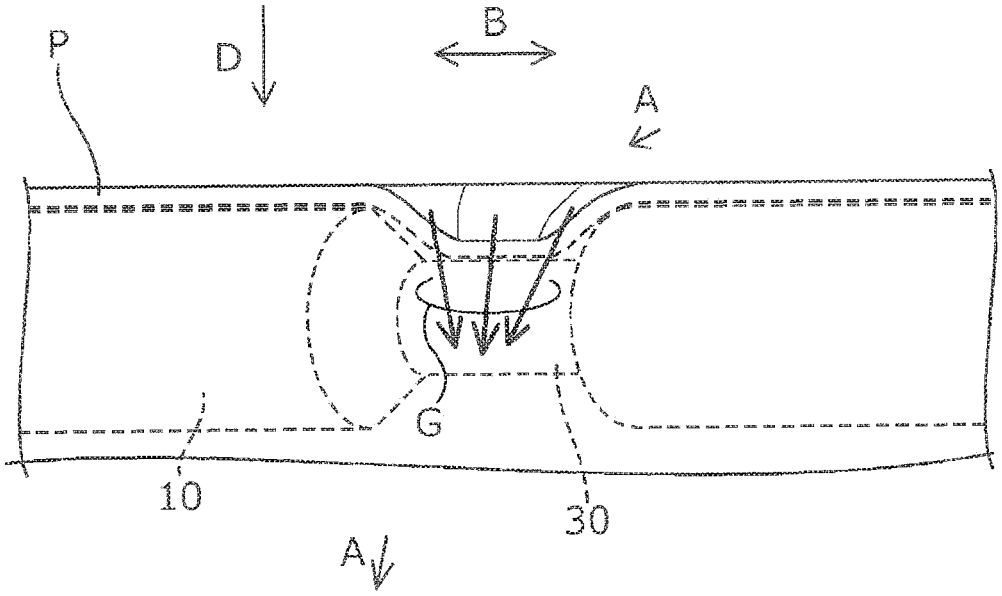
FIG. 4 is a schematic perspective view of the main part of the recording device according to the first embodiment of the invention.

FIG. 2 is a schematic plan view of a main part of the recording device 1 that shows a region of the transporting path of the target recording medium P from the driven rollers 7 to the assist roller 10. Moreover, FIG. 3 is a schematic perspective view of the driven rollers 7. FIG. 4 is a schematic perspective view of the assist roller 10.

As illustrated in FIGS. 2 and 3, the driven rollers 7 of this embodiment form driven roller units U. Then, as illustrated in FIG. 2, in the recording device 1 of this embodiment, a plurality of driven roller units U each provided with a plurality (three) of the driven rollers 7 are arranged in such a manner that the driven rollers 7 form a line in the intersecting direction B.

In a liquid ejecting apparatus having a transporting mechanism of such a structure, swelling of the target recording medium P with the ejection of liquid onto the target recording medium P, swelling due to the target recording medium P absorbing water vapor in the atmosphere, or swelling due to the target recording medium P being heated by a heater may result in wrinkling of the target recording medium P. FIG. 3 illustrates a state in which the target recording medium P has swelled and the wrinkles W1 and wrinkles W2 have occurred. In the manner of the recording device 1 of this embodiment, in a structure in which a plurality of the driven rollers 7 (a plurality of interposing portions of the target recording medium P) are arranged parallel to the intersecting direction B, the wrinkles W1 and W2 occur in spaces S1 and S2 of the driven rollers 7. Further, FIG. 3 illustrates that the spaces S2 neighboring the driven rollers 7 in different driven roller units U is larger than the spaces S1 neighboring individual ones of the driven rollers 7 formed in the same driven roller unit U, and that in accordance with the size of the space, the wrinkles W2 corresponding to spaces S2 rise from the platen 3 to a greater degree than the wrinkles W1 corresponding to spaces S1.

When such wrinkles W1 and W2 reach the liquid ejection region R, the target recording medium P comes into contact with the recording head 12, and a decrease in the impact accuracy of the ink (decrease in image quality) or the like may occur. Therefore, in the recording device 1 of this embodiment, in order to reduce the wrinkles W1 and W2, as illustrated in FIGS. 2 and 4, the assist roller 10 is provided with the concave portions 30 for reducing the wrinkles W1 and W2.

As described above, in the recording device 1 of this embodiment, the target recording medium P has a tension applied thereto in the transporting direction A and is pushed toward the assist roller 10. When the target recording medium P is pushed against the assist roller 10, as illustrated in FIG. 4, a force G that is drawn toward the concave portions 30 is applied to the target recording medium P. The wrinkles W1 and W2 on the platen 3 including the liquid ejection region R are reduced or eliminated, due to a portion of the target recording medium P that has become swollen and enlarged in the intersecting direction B being drawn toward the concave portions 30 due to this force G.

In summary, the recording device 1 of this embodiment has the recording head 12 that ejects ink onto the target recording medium P, the transporting mechanism for the target recording medium P, and the assist roller 10 having the concave portions 30, which is provided downstream of the recording head 12 in the transporting direction A of the target recording medium P. Then, the target recording medium P is pushed against the concave portions 30 (the target recording medium P is pushed in). Because of such a structure, as a result of the concave portions 30 being arranged at positions corresponding to specific portions in a structure in which the spaces S1 and S2 of the driven rollers 7 (as the specific portions) particularly easily rise up and the target recording medium P being pushed against the concave portions 30, the wrinkles W1 and W2 which easily occur in the specific portions can be effectively suppressed. Therefore, the wrinkles W1 and W2 that occur in the liquid ejection region R can be suppressed.

Here, by arranging the assist roller 10 having the concave portions 30 for suppressing the wrinkles W1 and W2 not on the upstream side but on the downstream side in the transporting direction A, a decrease in the transporting efficiency due to the target recording medium P being pushed against the concave portions 30 can be easily suppressed. For example, the target recording medium P is not pulled toward the upstream side in the transporting direction A (a direction opposite to the transporting direction A). This is because a structure that pulls the target recording medium P towards the downstream side in the transporting direction A can be easily formed.

Further, the member that has the concave portions 30 against which the target recording medium P is pushed is the assist roller 10; however, the member is not limited to this. Even something that does not rotate may be used and it need not be in the shape of a roller such as one having a semi-cylindrical shape. In addition, for example, a structure in which the platen 3 and the platen 4 are in contact with each other, or a corner region formed by such a contact may be used.

Moreover, as illustrated in FIG. 2, the transporting mechanism of this embodiment has rollers (the driven rollers 7) that are disposed upstream of the recording head 12 in the transporting direction A and that come into contact with the target recording medium P at a plurality of contact positions in the intersecting direction B that intersects the transporting direction A.

Whereas the transporting mechanism having rollers that come into contact with the target recording medium P at a plurality of contact positions has a structure that has a high transporting accuracy and is easy to form, wrinkles (the wrinkles W1 and W2) easily occur in the space portions (the spaces S1 and S2) between the contact positions. However, the recording device 1 of this embodiment has the assist roller 10 that has the concave portions 30, and the setting unit 14 and the winding unit 15 serving as an introducing mechanism for introducing the target recording medium P to the concave portions 30. Because of this, the concave portions 30 are arranged at positions corresponding to the space portions, and by pushing the target recording medium P against the concave portions 30 the wrinkles W1 and W2 that easily occur in the space portion can be suppressed effectively. Therefore, together with ease of formation of a transporting mechanism that has a high transporting accuracy, the wrinkles W1 and W2 that occur in the liquid ejection region R can be suppressed.

Moreover, in the recording device 1 of this embodiment, as illustrated in FIG. 2, the concave portions 30 are arranged at positions downstream of the spaces S2 in the transporting direction A. In other words, the concave portions 30 are arranged at positions (spaces S2) corresponding to positions between neighboring contact positions of the driven rollers 7 and the target recording medium P in the transporting direction A. Consequently, because the concave portions 30 are arranged at positions corresponding to the space portions of the driven rollers 7, by pushing the target recording medium P against the concave portions 30, the wrinkles W1 and W2 that easily occur in the space portions can be suppressed effectively. Therefore, together with ease of formation of a transporting mechanism that has a high transporting accuracy, the wrinkles W2 that occur in the liquid ejection region R can be suppressed.

Further, in the recording device 1 of this embodiment, the concave portions 30 are arranged only at positions corresponding to the spaces S2. In such a structure, it is possible to reduce the wrinkles W1 corresponding to the spaces S1. This is because the distance by which the target recording medium P can be pulled in the intersecting direction B by the concave portions 30 is large relative to the swelling amount of the target recording medium P in the intersecting direction B. However, in order to further effectively reduce the wrinkles W1 corresponding to the spaces S1, the concave portions 30 may be further arranged at positions corresponding to the spaces S1.

Moreover, in the recording device 1 of this embodiment, the setting unit 14 and the winding unit 15 that form the transporting mechanism and the introducing mechanism transport the target recording medium P while applying a tension in the transporting direction A. Then, as illustrated in FIG. 1, by arranging the assist roller 10 so as to subject the target recording medium P to tensions in different directions with the assist roller 10 as a reference when viewed from a direction (namely, the intersecting direction B) that intersects the transporting direction A and the ink ejection direction (direction D) (a horizontal direction on the upstream side of the assist roller 10 in the transporting direction A, an oblique direction at an angle to the horizontal direction on the downstream side of the assist roller 10 in the transporting direction A), the target recording medium P is pushed against the concave portions 30. That is, the surface 17 of the target recording medium P is pushed against the assist roller 10. Because of such a structure, in the recording device 1 of this embodiment, an introducing mechanism that does not come into contact with a side of the target recording medium P on which liquid is applied (the recording surface 16) can easily be formed.

Further, a structure "that transports the target recording medium P while applying a tension in the transporting direction A", similarly to the recording device 1 of this embodiment, includes the setting unit 14 for setting the target recording medium P having a roll shape and the winding unit 15 for winding the target recording medium P into a roll shape, can be considered as a so-called "roll to roll" structure or the like that can transport the target recording medium P while applying a tension in the transporting direction A from the setting unit 14 to the winding unit 15. However, the structure is not limited to such a structure.

Moreover, in the recording device 1 of this embodiment, the member having the concave portions 30 against which the target recording medium P is pushed is the assist roller 10 that assists in the transporting of the target recording medium P. Consequently, not only are the wrinkles W1 and W2 suppressed, but the transporting accuracy of the target recording medium P is also increased. Further, the assist roller 10 of this embodiment is a driven roller; however, a driving roller capable of driving so as to rotate at a speed corresponding to the transporting speed of the target recording medium P may be used.

Next, the electrical structure of the recording device 1 of this embodiment will be described.

Figure 5:
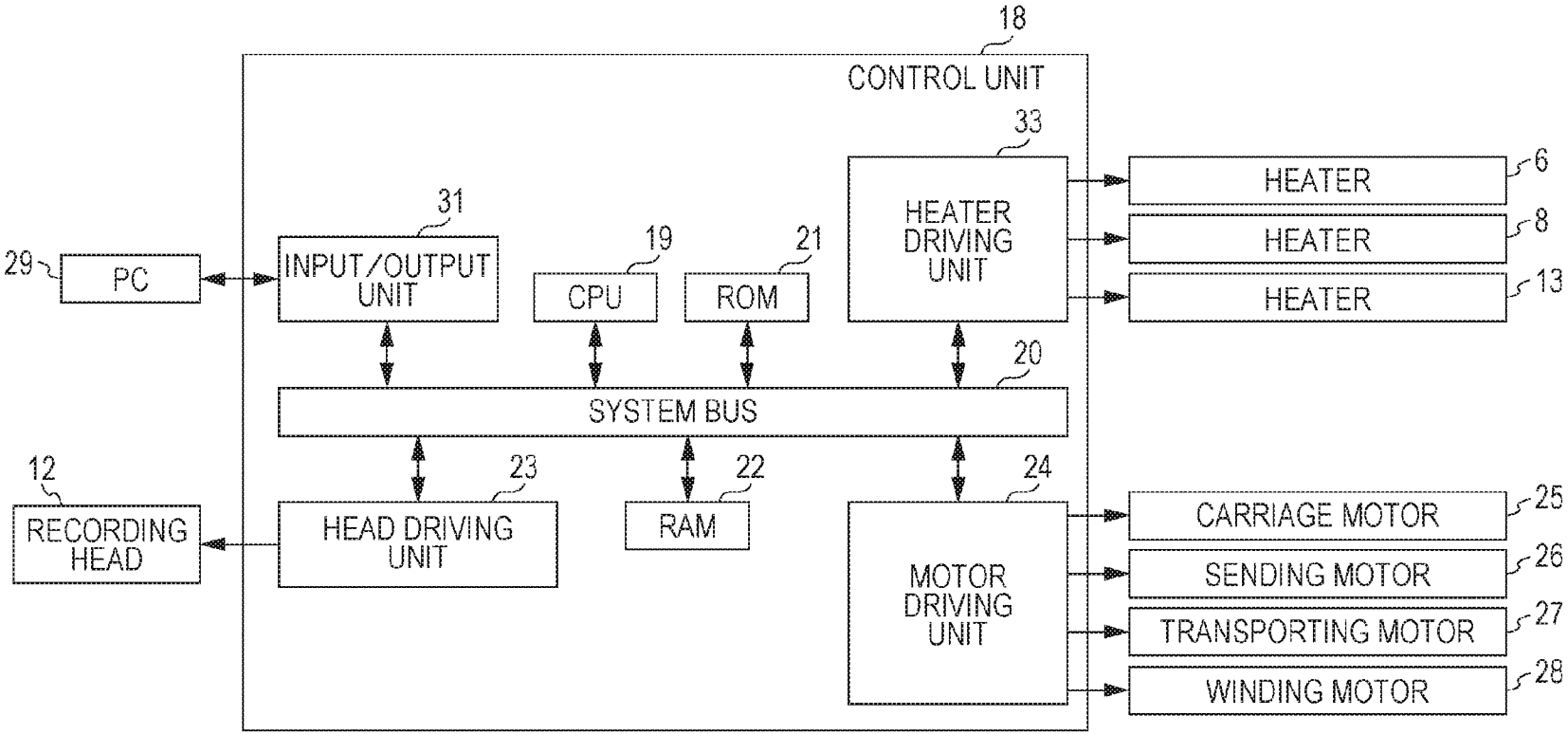
FIG. 5 is a block diagram illustrating the recording device according to a first embodiment of the invention.

FIG. 5 is a block diagram illustrating the recording device 1 of this embodiment.

A CPU 19 that performs control of the whole of the recording device 1 is provided in a control unit 18. The CPU 19, via a system bus 20, is connected to a ROM 21 on which are stored various control programs that the CPU 19 carries out and a RAM 22 that is capable of temporarily storing data.

Moreover, the CPU 19, via the system bus 20, is connected to a head driving unit 23 that drives the recording head 12.

Moreover, the CPU 19, via the system bus 20, is connected to a motor driving unit 24 for driving a carriage motor 25 for moving the carriage 11, a sending motor 26 which is the driving source of the setting unit 14, a transporting motor 27 which is a driving source of the drive rollers 5, and a winding motor 28 which is a driving source of the winding unit 15.

Moreover, the CPU 19, via the system bus 20, is connected to a heater driving unit 33 for driving the heaters 6, 8, and 13.

Furthermore, the CPU 19, via the system bus 20, is connected to an input/output unit 31 and the input/output unit 31 is connected to a PC 29 that is an external device for inputting recording data or the like to the recording device 1.

Figure 6:
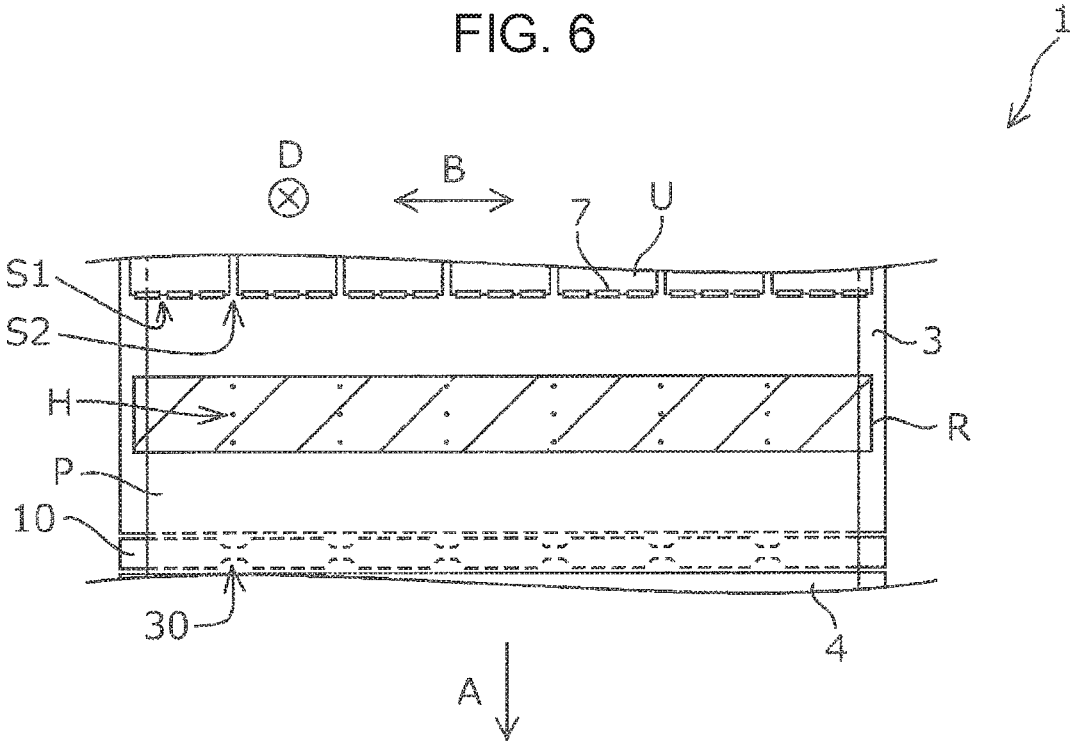
FIG. 6 is a schematic plan view of a main part of a recording device according to a second embodiment of the invention.

Second Embodiment (FIG. 6)

Next, a recording device of a second embodiment will be described with reference to the accompanying drawings.

FIG. 6 is a schematic plan view of the main part of the recording device 1 of this embodiment and is a diagram corresponding to FIG. 2, which illustrates the recording device 1 of the first embodiment. Further, elements equivalent to those of the above-described first embodiment have the same reference numerals and description thereof is omitted.

Further, the recording device 1 of this embodiment, with the exception of the structure of the platen 3, has the same structure as the recording device 1 of the first embodiment. Specifically, suction holes H are provided in the platen 3, and the surface 17 of the target recording medium P can be pushed against the platen 3 by a suction force provided by a suction mechanism (not illustrated) via the suction holes H.

As illustrated in FIG. 6, the recording device 1 of this embodiment similarly to the recording device 1 of the first embodiment, has the platen 3 which is a supporting unit that supports the target recording medium P on the transporting path of the target recording medium P. Suction holes H are provided in the platen 3. Here, the suction holes H, as illustrated in FIG. 6, are arranged so as to correspond to a portion downstream, in the transporting direction A, of the spaces S2 that particularly easily rise up. Consequently, in a structure in which a specific portion easily rises up, because the suction holes H are arranged at positions corresponding to the specific portions in the platen 3, it is possible to particularly effectively suppress the wrinkles W2 that easily occur in the specific portion. Therefore, it is possible to particularly effectively suppress the wrinkles W2 that occur in the liquid ejection region R.

Figure 7:
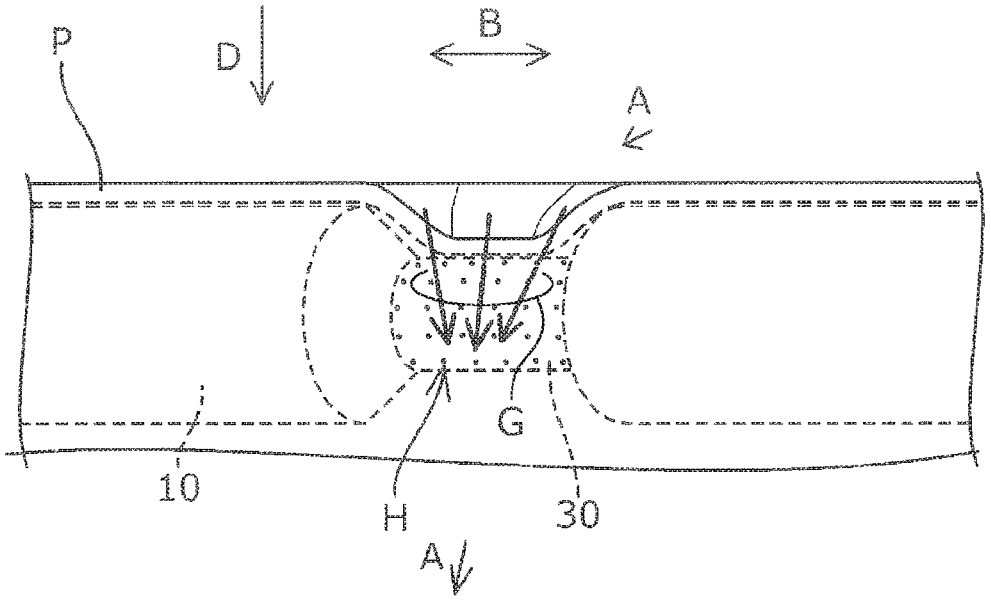
FIG. 7 is a schematic perspective view of a main part of a recording device according to a third embodiment of the invention.

Third Embodiment (FIG. 7)

Next, a recording device of a third embodiment will be described with reference to the accompanying drawings.

FIG. 7 is a schematic perspective view of the main part of the recording device 1 of this embodiment and is a diagram corresponding to FIG. 4 that illustrates the recording device 1 of the first embodiment. Further, elements equivalent to those of the above-described first and second embodiments have the same reference numerals and description thereof is omitted.

Further, the recording device 1 of this embodiment, with the exception of the structure of the assist roller 10, has the same structure as the recording device 1 of the first embodiment. Specifically, suction holes H are provided in the assist roller 10, and the surface 17 of the target recording medium P can be pushed against the assist roller 10 by a suction force provided by a suction mechanism (not illustrated) via the suction holes H.

As illustrated in FIG. 7, in the recording device 1 of this embodiment, suction holes H are provided in the concave portions 30. Consequently, the effect of pushing the target recording medium P against the concave portions 30 is improved and the wrinkles W1 and W2 that occur in the liquid ejection region R can be suppressed effectively.

Figure 8:
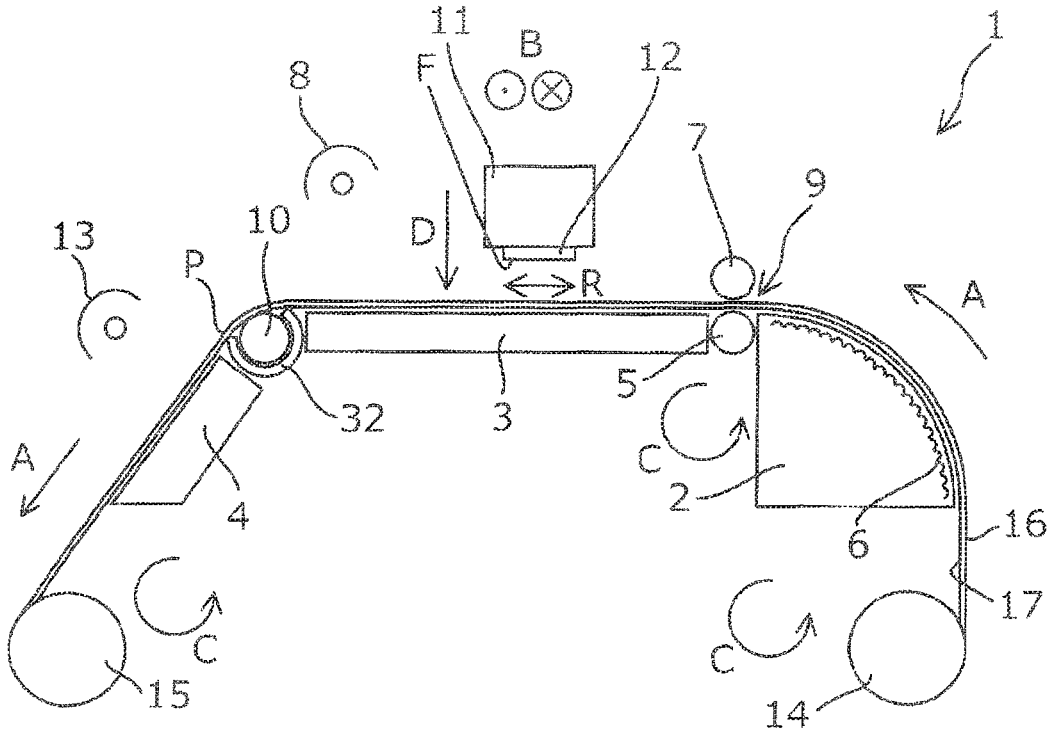
FIG. 8 is a schematic side view of a recording device according to a fourth embodiment of the invention.

Fourth Embodiment (FIG. 8)

Next, a recording device of a fourth embodiment will be described with reference to the accompanying drawings.

FIG. 8 is a schematic side view of the main part of the recording device 1 of this embodiment and is a diagram corresponding to FIG. 1 that illustrates the recording device 1 of the first embodiment. Further, elements equivalent to those of the above-described first to third embodiments have the same reference numerals and description thereof is omitted.

Further, the recording device 1 of this embodiment, with the exception of the provision of a cover unit 32 that covers the suction holes H of the assist roller 10, has the same structure as the recording device 1 of the third embodiment.

In the recording device 1 of this embodiment, suction holes H are provided in the concave portions 30 as described above and, as illustrated in FIG. 8, the cover unit 32 that covers the suction holes H is provided on a side of the assist roller 10 different from the side which comes into contact with the target recording medium P. Consequently, by suppressing suction from the side of the assist roller 10 that is different from the side that comes into contact with the target recording medium P, it is possible to increase the suction force on the side of the assist roller 10 that comes into contact with the target recording medium P. That is, it is possible to particularly improve the effect of pushing the target recording medium P against the concave portions 30 and the wrinkles W1 and W2 that occur in the liquid ejection region R can be effectively suppressed.

Further, the cover unit 32 of this embodiment is a structure that is formed of a material having a coefficient of friction that is lower than that of the concave portions 30 of the assist roller 10 and is constantly in contact with the concave portions 30. However, the structure is not limited to such a structure and a structure in which the cover unit 32 is capable of coming into contact with and separating from the concave portions 30, a structure in which the cover unit 32 is slightly spaced apart from the concave portions 30, or the like may be used.

Further, the invention is not limited to the above-described embodiments and various modifications are possible within the parameters of invention that are listed in the scope of the claims, and it goes without saying that they are included in the scope of the invention.

This application claims priority under 35 U.S.C. §119 to Japanese Patent Application No. 2015-143686, filed Jul. 21, 2015. The entire disclosure of Japanese Patent Application No. 2015-143686 is hereby incorporated herein by reference.

What is claimed is:

1. A liquid ejecting apparatus comprising:

a liquid ejecting unit that ejects a liquid onto a medium, a transporting mechanism that transports the medium, a member having concave portions, wherein the member is arranged downstream of the liquid ejecting unit in a transporting direction of the medium, an introducing mechanism that introduces the medium to the concave portions, wherein the transporting mechanism includes rollers that come into contact with the medium at a plurality of contact positions in a direction that intersects the transporting direction, and the concave portions of the member are arranged at positions that correspond to positions between neighboring ones of the contact positions in the direction intersecting the transporting direction, wherein the member is arranged such that the medium is pressed against the concave portions by the introducing mechanism.

2. The liquid ejecting apparatus according to claim 1, wherein the transporting mechanism transports the medium while applying a tension in the transporting direction, and the introducing mechanism is a structure that pushes the medium against the concave portions due to the member being arranged so as to subject the medium to tensions in different directions with the member as a reference when viewed from a direction that intersects the transporting direction and an ejection direction of the liquid.

3. The liquid ejecting apparatus according to claim 1, wherein the member is an assist roller that assists in transporting of the medium.

4. The liquid ejecting apparatus according to claim 1, wherein suction holes are arranged in the concave portions.

5. The liquid ejecting apparatus according to claim 3, wherein suction holes are arranged in the concave portions, and a cover unit that covers the suction holes is arranged on a side of the assist roller that is different from a side that comes into contact with the medium.

6. The liquid ejecting apparatus according to claim 1, further comprising a supporting unit that supports the medium in a transporting path of the medium, and suction holes arranged in the supporting unit.

* * * * *